United States Patent [19]

Galloway et al.

[11] Patent Number: 4,573,581

[45] Date of Patent: Mar. 4, 1986

[54] ENVIRONMENTALLY CONTROLLED MEDICATION CONTAINER

[75] Inventors: Howard R. Galloway, Adelaide; Gary Shanks, Hawthorn, both of Australia

[73] Assignee: Network Medical Containers Pty, Ltd., Wayville, Australia

[21] Appl. No.: 629,454

[22] Filed: Jul. 10, 1984

[30] Foreign Application Priority Data

Jul. 18, 1983 [AU] Australia ..... PG0319

[51] Int. Cl.[4] ..... B65D 81/38; B65D 85/56; F25D 3/08; A45C 11/00

[52] U.S. Cl. ..... 206/570; 206/37; 206/316; 206/545; 206/535; 220/415; 220/902; 62/371; 62/457; 62/530

[58] Field of Search ..... 206/570, 37, 572, 316, 206/535, 5.7, 38, 545; 62/457, 371, 530; 220/902, 415

[56] References Cited

U.S. PATENT DOCUMENTS

| | | | |
|---|---|---|---|
| 3,155,264 | 11/1964 | Shook | 206/316 |
| 4,250,998 | 2/1981 | Taylor | 206/570 |
| 4,322,954 | 4/1982 | Sheehan et al. | 62/371 |
| 4,393,975 | 7/1983 | Moore | 62/457 |
| 4,420,076 | 12/1983 | Bevridge et al. | 206/37 |

*Primary Examiner*—William T. Dixson, Jr.
*Attorney, Agent, or Firm*—Larson and Taylor

[57] ABSTRACT

This invention relates to a container for carrying temperature-sensitive materials, having a case and inner chamber separated by a cavity containing thermal insulation, characterized in that the thermal insulating means includes a heat sink whereby the contents of the inner cavity is protected from a temperature increase for a period sufficient to avoid deterioration under normal conditions of use.

7 Claims, 3 Drawing Figures

ENVIRONMENTALLY CONTROLLED MEDICATION CONTAINER

This invention is directed to means for protecting pharmaceutical preparations or other chemicals from degradation by ambient conditions of temperature and environment.

BACKGROUND OF THE INVENTION

Many materials, and notably a large range of important pharmaceutical preparations, are subject to accelerated degradation by temperature and other environmental conditions. In particular, a number of commonly prescribed medications are temperature and light unstable. The best known is glyceryltrinitrate. Others include benzodiazepines, prochlorperazine, penicillin, pseudoephedrine, promethazine, prednisolone and captopril.

The manufacturers of glyceryltrinitrate recommend that the tablets be stored at temperatures of less than 25° C. and protected from light. The standard brown glass bottle falls far short of these criteria; for example these types of containers reach an internal temperature of 25° C. within 20 minutes of removal from a refrigerator, and the temperature of tablets carried in a shirt or trouser pocket rapidly reaches 35° C.

There have been two previous attempts to provide an insulated container for heat-sensitive materials. Southwick (U.S. Pat. No. 3,472,568; 1969) describes a fibre container having an inner insulating layer with a removable inner receptacle, the insulating layer being surrounded by a hard exterior shell with detachable top. The novel feature of this invention was a humidity control device. This invention was not directed specifically at protection of pharmaceuticals. Lowe (U.S. Pat. No. 4,054,208; 1977) describes a container for medicinal tablets, capsules or pills, to be carried on the person, consisting of two concentric cylindrical tubes, the inner tube being of translucent amber-coloured plastic or glass, separated from an outer transparent tube by an air space. This invention was intended to protect pharmaceutical products from body heat, light, and moisture, as well as from mechanical damage. No insulation or heat-protective device other than the airspace was incorporated into the invention.

It is an object of this invention to overcome the defects of the prior art by providing a container with superior protective properties, particularly against the deleterious effects of heat.

GENERAL DESCRIPTION OF THE INVENTION

In a general aspect the invention provides a container having an outer case, and an inner chamber, which may for example be cylindrical and suitable for holding a small number of tablets. The cavity between the chamber and the case contains thermal insulating material, including a heat sink, so that the contents of the chamber are protected from deleterious rise in temperature following a rise in temperature of the case, as will occur when the container is removed from a refrigerator and carried on the user's person.

In a more particular aspect the invention provides a container having an outer case and an inner chamber, and thermal insulating means therebetween, characterized in that the thermal insulating means includes a heat sink whereby rise in temperature of the contents of the inner chamber following exposure of the outer casing to an increased temperature is delayed for a period sufficient to avoid deterioration of the contents of the chamber, under normal conditions of use.

The outer case is preferably made of opaque, rigid material.

The heat sink, which may comprise degraded collagen matrix containing thermal and chemical stabilizers, is preferably surrounded by a reflecting and conductive shield. It may also be surrounded by heat insulating foam, for example expanded polystyrene.

SUMMARY AND DETAILED DESCRIPTION

The present invention incorporates the use of an opaque, inert, rigid construction material to protect the contents of the container from mechanical damage and from degradation by light. Insulating layers of foam and of aluminium foil, and the use of a heat sink chamber to surround the tablet chamber also give excellent protection of the contents from heat.

Figure 1:
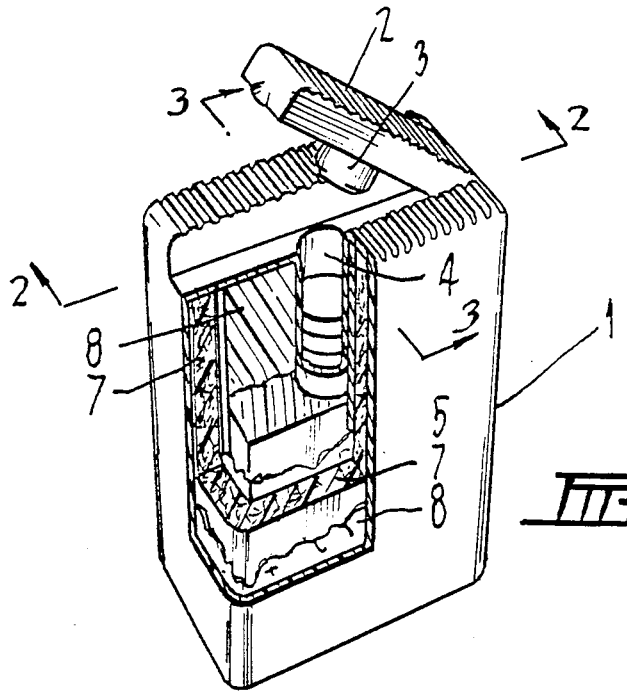
FIG. 1 is a schematic representation of a container manufactured in accordance with a preferred embodiment of the present invention.
Figure 2:
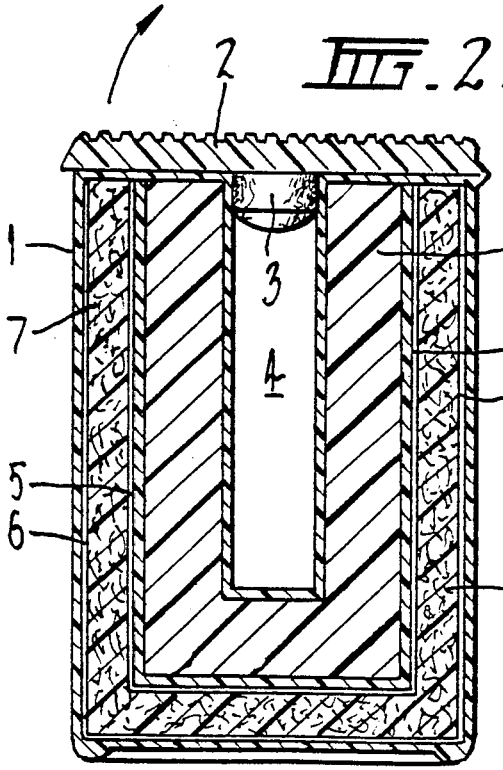
FIG. 2 is a cross-section taken on line 2—2 of FIG. 1.
Figure 3:
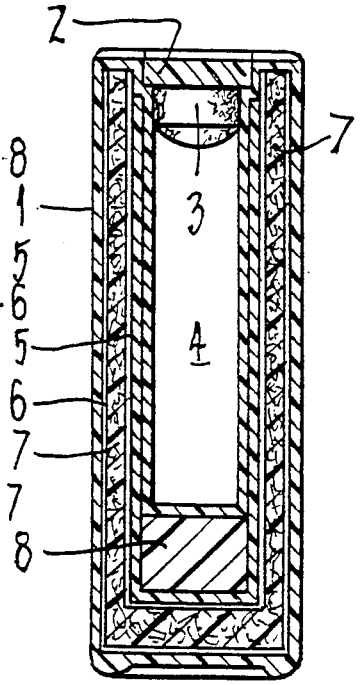
FIG. 3 is a cross-section taken on line 3—3 of FIG. 1.

The container comprises an external case 1 of synthetic resinous material having a ridged, hinged lid 2 which carries a stopper, 3 which registers with medication tube, 4 to seal the said tube in an airtight manner. The container is internally insulated by a multi-layer reflecting shield comprising aluminium foil layers 2 and 6, an expanded polystyrene layer 7, surrounding heat sink 8, containing degraded collagen matrix and agar having metabisulphite as chemical stabilizer. Heat sink 8 surrounds tablet tube 4, which is made from a synthetic resin which does not absorb the vapour phase of the contained medication e.g. polyethylene or polypropylene in the case of glyceryltrinitrate.

This container will maintain an internal temperature of less than 25° C. for over 4 hours after removal from the refrigerator and returns to base temperature within 30 to 60 minutes when placed in a normal domestic refrigerator or freezer.

The present container is not intended to replace the manufacturer's container. It is designed to ensure that prescribed medications remain stable whilst they are carried about the person. The following embodiments are within the scope of this invention.

We claim:

1. A container having an outer case and an inner chamber, and thermal insulating means in a cavity therebetween characterized in that the casing is of opaque rigid material, and the thermal insulating means includes a heat sink and a reflective and conductive shield surrounding the heat sink, whereby rise in temperature of the contents of the inner chamber following exposure of the outer casing to an increased temperature is delayed for a period sufficient to avoid deterioration of the contents of the chamber, under normal conditions of use.

2. A container according to claim 1, wherein the heat sink comprises degraded collagen matrix containing thermal and chemical stabilizers.

3. A container according to claim 1, wherein the heat sink is surrounded by heat-insulating foam.

4. A container according to claim 1, of a size suitable for carrying on or about the person, for carrying a small supply of pharmaceutical preparations which are susceptible to degradation by heat or light.

5. A pharmaceutical pack constructed in accordance with claim 1, and containing a supply of tablets, capsules, suppositories, ampoules, or ophthalmic solutions which are susceptible to degradation by heat or light, to be carried in the pocket or handbag of the patient.

6. A container as defined in claim 1, adapted to carry or store any objects, materials or chemicals which are susceptible to degradation by heat or light.

7. A container as defined in claim 1, adapted to carry or store photographic films or photographic chemicals.

* * * * *